US006002199A

United States Patent [19]

Spindt et al.

[11] Patent Number: 6,002,199

[45] Date of Patent: Dec. 14, 1999

[54] STRUCTURE AND FABRICATION OF ELECTRON-EMITTING DEVICE HAVING LADDER-LIKE EMITTER ELECTRODE

[75] Inventors: Christopher J. Spindt, Menlo Park; Stephanie J. Oberg, Sunnyvale; Duane A. Haven, Umpqua; Roger W. Barton, Palo Alto; Arthur J. Learn, Cupertino; Victoria A. Bascom, Newman, all of Calif.

[73] Assignee: Candescent Technologies Corporation, San Jose, Calif.

[21] Appl. No.: 08/866,150

[22] Filed: May 30, 1997

[51] Int. Cl.[6] ..... H01J 1/30; H01J 19/24

[52] U.S. Cl. ..... 313/309; 313/336; 313/306

[58] Field of Search ..... 313/309, 310, 313/311, 351, 336, 306, 308; 315/169.4

[56] References Cited

U.S. PATENT DOCUMENTS

| | | | |
|---|---|---|---|
| 4,178,531 | 12/1979 | Alig | 313/409 |
| 4,874,981 | 10/1989 | Spindt | 313/309 |
| 4,940,916 | 7/1990 | Borel et al. | 313/306 |
| 5,070,282 | 12/1991 | Epsztein | 315/383 |
| 5,191,217 | 3/1993 | Kane et al. | 313/308 |
| 5,235,244 | 8/1993 | Spindt | 313/495 |
| 5,315,207 | 5/1994 | Hoeberechts et al. | 313/444 |
| 5,374,868 | 12/1994 | Tjaden et al. | 313/310 |
| 5,528,103 | 6/1996 | Spindt et al. | 313/497 |
| 5,543,683 | 8/1996 | Haven et al. | 313/461 |
| 5,559,389 | 9/1996 | Spindt et al. | 313/310 |
| 5,564,959 | 10/1996 | Spindt et al. | 445/24 |
| 5,649,847 | 7/1997 | Haven | 445/24 |
| 5,650,690 | 7/1997 | Haven | 313/422 |
| 5,818,403 | 10/1998 | Nakamura et al. | 313/309 |
| 5,828,163 | 10/1998 | Jones et al. | 313/336 |

FOREIGN PATENT DOCUMENTS

| | | | |
|---|---|---|---|
| WO 92/09095 | 5/1992 | WIPO | H01J 3/02 |

OTHER PUBLICATIONS

Kim et al, "High–Aperture and Fault–Tolerant Pixel Structure for TFT–LCDs", *SID 95 Digest,* 1995, pp. 15–18, (No month).

Thompson et al, *An Introduction to Microlithography* (2nd ed.), 1994, pp. 162–169, (No month).

*Primary Examiner*—Michael Day

*Attorney, Agent, or Firm*—Skjerven, Morrill, MacPherson, Franklin & Friel LLP; Ronald J. Meetin

[57] ABSTRACT

An electron-emitting device utilizes an emitter electrode (12) shaped like a ladder in which a line of emitter openings (18) extend through the electrode. In fabricating the device, the emitter openings can be utilized to self-align certain edges, such as edges (38C) of a focusing system (37), to other edges, such as edges (28C) of control electrodes (28), to obtain desired lateral spacings. The self-alignment is typically achieved with the assistance of a backside photolithographic exposure operation. The ladder shape of the emitter electrode also facilitates the removal of short-circuit defects involving the electrode.

52 Claims, 6 Drawing Sheets

STRUCTURE AND FABRICATION OF ELECTRON-EMITTING DEVICE HAVING LADDER-LIKE EMITTER ELECTRODE

FIELD OF USE

This invention relates to electron-emitting devices. More particularly, this invention relates to the structure and fabrication, including testing, of an electron-emitting device suitable for use in a flat-panel display of the cathode-ray tube ("CRT") type.

BACKGROUND

A flat-panel CRT display basically consists of an electron-emitting device and a light-emitting device that operate at low internal pressure. The electron-emitting device, commonly referred to as a cathode, contains electron-emissive elements that emit electrons over a wide area. The emitted electrons are directed towards light-emissive elements distributed over a corresponding area in the light-emitting device. Upon being struck by the electrons, the light-emissive elements emit light that produces an image on the viewing surface of the display.

Specifically, the electron-emissive elements are conventionally situated over generally parallel emitter electrodes that are opaque—i.e., impervious to light, typically ultraviolet ("UV") and infrared ("IR") light as well as visible light. In an electron-emitting device that operates according to field-emission principles, control electrodes typically cross over, and are electrically insulated from, the emitter electrodes. A set of electron-emissive elements are electrically coupled to each emitter electrode where it is crossed by one of the control electrodes. The electron-emissive elements are exposed through openings in the control electrodes. When a suitable voltage is applied between a control electrode and an emitter electrode, the control electrode extracts electrons from the associated electron-emissive elements. An anode in the light-emitting device attracts the electrons to the light-emissive elements.

The electron-emitting device in a flat-panel CRT display commonly contains a focusing structure that helps control the trajectories of the electrons so that they largely only strike the intended light-emissive elements. The focusing structure normally extends above the control electrodes. The lateral relationship of the focusing structure to the sets of electron-emissive elements is critical to achieving high display performance. In fabricating the electron-emitting device, the opaque nature of the emitter electrodes can present an impediment to achieving the requisite lateral spacing between the focusing structure and the sets of electron-emissive elements. Accordingly, it would be desirable to configure the emitter electrodes in such as way as to facilitate controlling the lateral positions of components, such as the focusing structure, in the electron-emitting device.

Short circuits sometime occur between the control electrodes, on one hand, and the emitter electrodes, on the other hand. The presence of a short circuit can have a very detrimental effect on the display's performance. For example, a short circuit at the crossing between a particular control electrode and a particular emitter electrode can prevent part or all of the set of electron-emissive elements associated with those two electrodes from operating properly. It would also be desirable to have a way for configuring the emitter electrodes to facilitate removal of short-circuit defects.

GENERAL DISCLOSURE OF THE INVENTION

In the present invention, an emitter electrode for an electron-emitting device is formed generally in the shape of a ladder. That is, a line of emitter openings extend through the emitter electrode. During fabrication of the electron-emitting device, the emitter openings can be utilized in a manner that permits features, such as a focusing system, to be self-aligned to other features, such as control electrodes, so as to achieve desired lateral spacings in the device.

For example, when at least part of the focusing system is created from actinic material, portions of the control electrodes typically overlie the emitter openings in the ladder-shaped emitter electrode. The actinic material is selectively exposed to backside actinic radiation that passes through the emitter openings. During the backside exposure, the portions of the control electrodes overlying the emitter openings serve as part of a radiation-blocking mask that results in edges of the focusing system being self-aligned to parts of the edges of the control electrodes. Similar self-alignment is achieved in creating other structures from actinic material using the control electrodes or other such features extending over the emitter openings as part of a mask for blocking backside actinic radiation that passes through the emitter openings.

The ladder shape of the present emitter electrode also enables defects such as short circuits to be removed from the electron-emitting device without significantly impairing device performance. In particular, the present emitter electrode typically contains a pair of rails connected by crosspieces. If a short circuit between the emitter electrode and an overlying control electrode occurs at one of the crosspieces, that crosspiece can be cut out of the emitter electrode. Likewise, if a short circuit occurs at one of the two rails at a location below a control electrode, that portion of the rail can be cut out of the emitter electrode. In either case, removal of the indicated portion of the emitter electrode does not significantly impair the ability of voltage to be impressed through the remainder of the emitter electrode.

Short-circuit removal can be performed through the back side (bottom) of the electron-emitting device utilizing a suitably focused energy beam such as a laser beam. Openings can be provided in the control electrodes to permit all short-circuit removals to be performed through the front side (top) of the electron emitter. The crosspieces of the ladder-shape emitter electrode can be specially shaped to facilitate short-circuit removal. For example, the ends of each crosspiece can neck down in width, thereby making it easier to cut through a crosspiece when necessary.

In short, the invention overcomes fabrication difficulties arising from the fact that the material of the emitter electrode is normally opaque and thus largely non-transmissive of actinic radiation. The openings in the present emitter electrode permit certain edges in the electron-emitting device to be self-aligned to other edges, thereby enabling certain critical spacings in the device to be well controlled. Device performance is improved. By facilitating short-circuit removal, the general ladder shape of the present emitter electrode leads to increased fabrication yield. The invention thus provides a significant advance.

Figure 1:
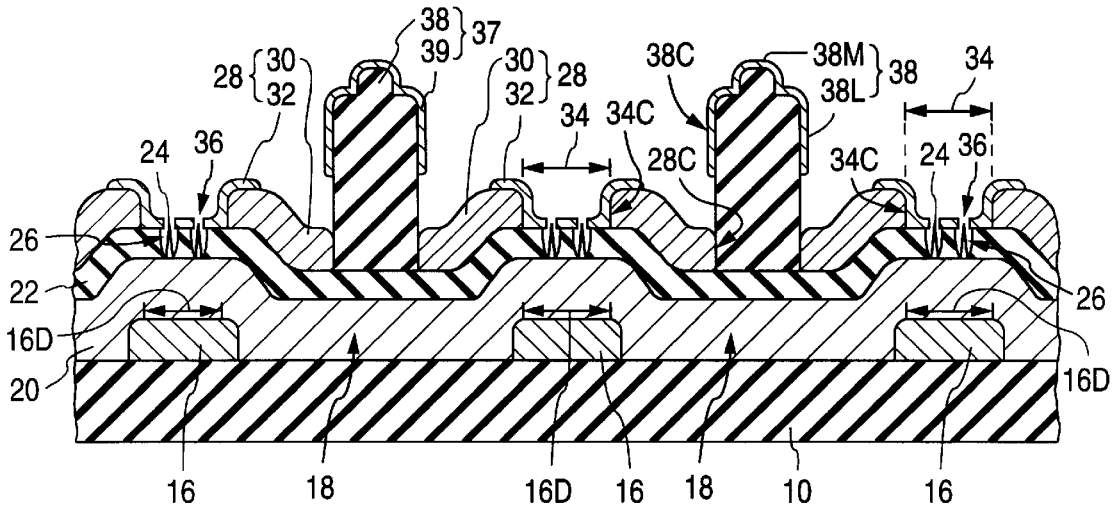
FIG. 1 is a cross-sectional side view of a portion of a electron-emitting device configured according to the invention so as to have emitter electrodes in the general shape of ladders.
Figure 2:
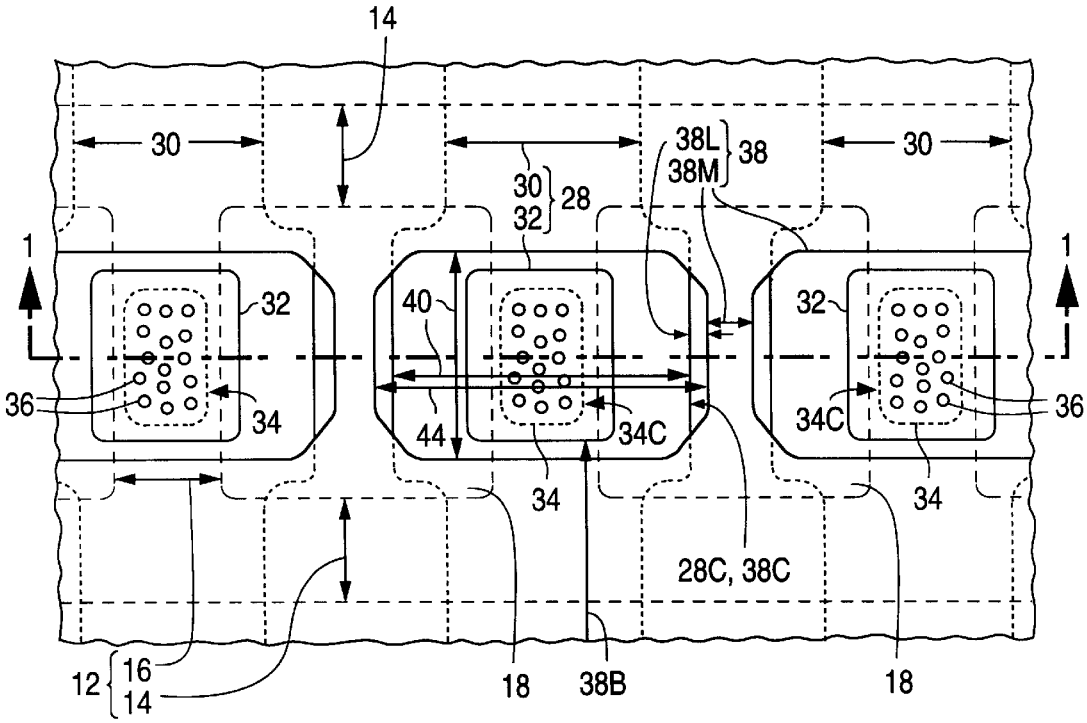
FIG. 2 is a plan view of the portion of the electron-emitting device in FIG. 1.
Figure 3:
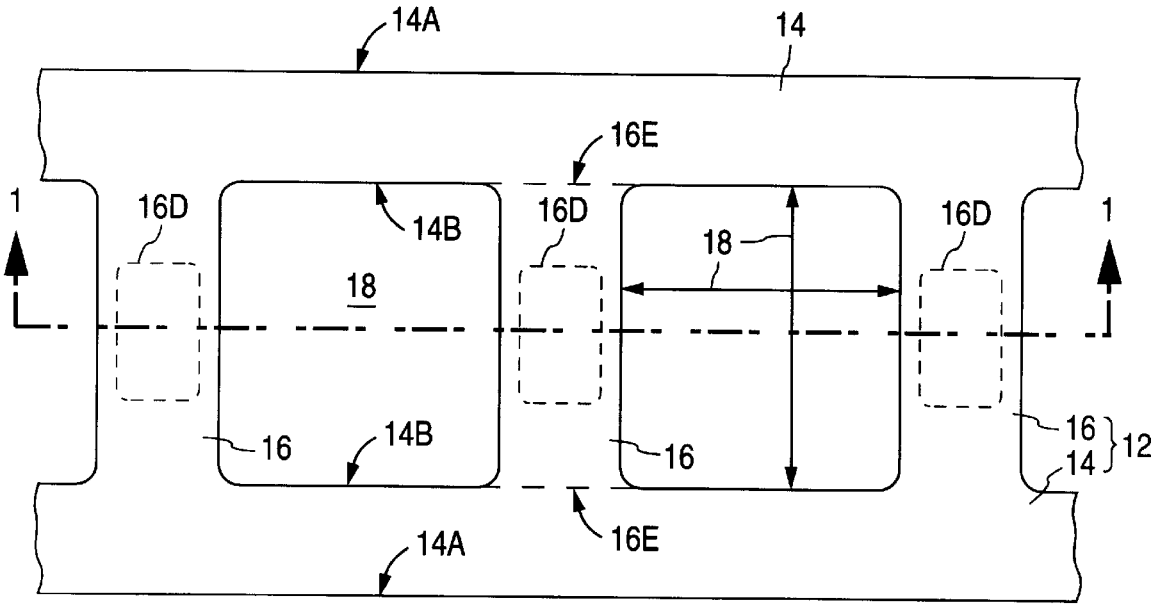
FIG. 3 is a plan view of the emitter electrode in the portion of the electron-emitting device in FIG. 1.
Figure 4:
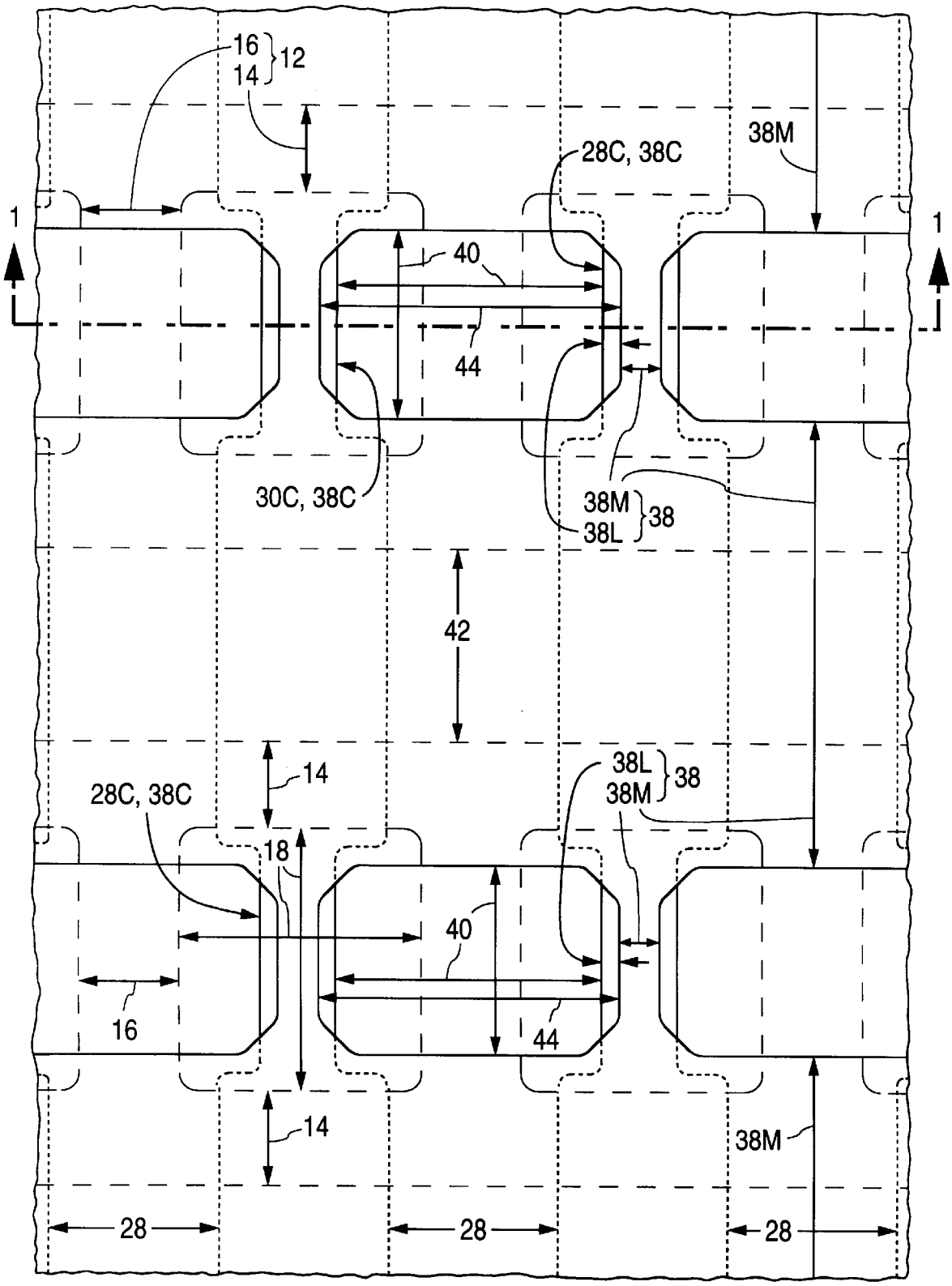
FIG. 4 is a plan view of the base focusing structure, column electrodes, and two emitter electrodes in the electron-emitting device of FIG. 1.
Figure 6:
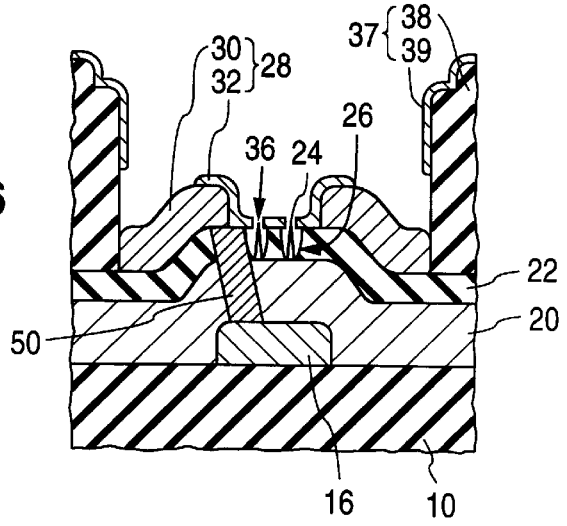
FIG. 6 is a simplified cross-sectional side view of a short-circuited segment of the portion of the electron-emitting device in FIG. 1.

The cross section of FIG. 1 is taken through plane 1—1 in each of FIGS. 2–4. The cross section of FIG. 6 is taken through plane 6—6 in FIG. 7.

Like reference symbols are employed in the drawings and in the description of the preferred embodiments to represent the same, or very similar, item or items.

DESCRIPTION OF THE PREFERRED EMBODIMENTS

The present invention furnishes a matrix-addressed gated electron-emitting device having a layer of emitter electrodes which, in plan view, are shaped generally like ladders. With respect to the emitter electrodes, "plan view" means as viewed in a direction generally perpendicular to the emitter-electrode layer. The electron emitter of the invention typically operates according to field-emission principles in producing electrons that cause visible light to be emitted from corresponding light-emissive phosphor elements of a light-emitting device. The combination of the electron-emitting and light-emitting devices forms a cathode-ray tube of a flat-panel display such as a flat-panel television or a flat-panel video monitor for a personal computer, a lap-top computer, or a workstation.

In fabricating the present electron emitter, actinic material is typically created in a desired shape by a procedure that involves exposing part of the material to backside actinic radiation that passes through the openings between the crosspieces of the ladder-shaped emitter electrodes. A layer of material is "actinic" when the layer can be patterned by exposing the layer to radiation that causes the exposed material to change chemical structure and then developing the layer to remove either the exposed material or the unexposed material. The present invention normally employs negative-tone actinic material in which the material remaining after the development step is the exposed material, the chemical structure of the exposed material typically having changed by undergoing polymerization. Radiation, typically UV light, is referred to as "actinic" to indicate that the radiation causes the changes in chemical structure of the material exposed to the radiation.

In the following description, the term "electrically insulating" (or "dielectric") generally applies to materials having a resistivity greater than $10^{10}$ ohm-cm. The term "electrically non-insulating" thus refers to materials having a resistivity below $10^{10}$ ohm-cm. Electrically non-insulating materials are divided into (a) electrically conductive materials for which the resistivity is less than 1 ohm-cm and (b) electrically resistive materials for which the resistivity is in the range of 1 ohm-cm to $10^{10}$ ohm-cm. These categories are determined at an electric field of no more than 1 volt/$\mu$m. Similarly, the term "electrically non-conductive" refers to materials having a resistivity of at least 1 ohm-cm, and includes electrically resistive and electrically insulating materials.

Examples of electrically conductive materials (or electrical conductors) are metals, metal-semiconductor compounds (such as metal silicides), and metal-semiconductor eutectics. Electrically conductive materials also include semiconductors doped (n-type or p-type) to a moderate or high level. Electrically resistive materials include intrinsic and lightly doped (n-type or p-type) semiconductors. Further examples of electrically resistive materials are (a) metal-insulator composites, such as cermet (ceramic with embedded metal particles), (b) forms of carbon such as graphite, amorphous carbon, and modified (e.g., doped or laser-modified) diamond, (c) and certain silicon-carbon compounds such as silicon-carbon-nitrogen.

Referring to the drawings, FIG. 1 illustrates a side cross section of part of a matrix-addressed gated electron-emitting device configured according to the invention. The device in FIG. 1 operates in field-emission mode and is often referred to here as a field emitter. FIG. 2 depicts a plan view of the part of the field emitter shown in FIG. 1. To simplify pictorial illustration, dimensions in the vertical direction in FIG. 2 are illustrated at a compressed scale compared to dimensions in the horizontal direction.

The field emitter of FIGS. 1 and 2 is employed in a color flat-panel CRT display divided into rows and columns of color picture elements ("pixels"). The row direction—i.e., the direction along the rows of pixels—is the horizontal direction in FIGS. 1 and 2. The column direction, which extends perpendicular to the row direction and thus along the columns of pixels, extends perpendicular to the plane of FIG. 1. The column direction extends vertically in FIG. 2. Each color pixel contains three sub-pixels, one for red, another for green, and the third for blue.

The field emitter of FIGS. 1 and 2 is created from a thin transparent flat baseplate 10. Typically, baseplate 10 consists of glass such as Schott D263 glass having a thickness of approximately 1 mm.

A group of opaque parallel laterally separated ladder-shaped emitter electrodes 12 are situated on baseplate 10. Emitter electrodes 12 extend in the row direction and thus constitute row electrodes. Each emitter electrode 12 consists of a pair of parallel equal-width straight rails 14 and a group of parallel equal-width straight crosspieces 16. The cross section of FIG. 1 is taken through a plane at which only crosspieces 16 are visible. FIG. 2 illustrates, in dashed line, rails 14 and crosspieces 16 of one emitter electrode 12.

FIG. 3, oriented the same as FIG. 2, illustrates the plan-view shape of one emitter electrode 12 more clearly. As shown in FIG. 3, crosspieces 16 extend generally perpendicular to rails 14. Each rail 14 has an outer longitudinal edge 14A and an inner longitudinal edge 14B. Each crosspiece 16 has a pair of ends that merge seamlessly into rails 14 along inner edges 14B. Dashed lines 16E in FIG. 3 indicate the locations of the ends of one crosspiece 16. Emitter openings 18 are situated between crosspieces 16. As FIG. 3 indicates, emitter openings 18 are generally rectangular and extend in a straight line.

The centerline-to-centerline spacing between the longitudinal centerlines (not shown) of emitter electrodes 12 is typically 270–300 $\mu$m. The overall width of each emitter electrode 12—i.e., the distance between outer rail edges 14A—is typically 210–230 $\mu$m. The width of each rail 14 is typically 30 $\mu$m. Accordingly, the dimension of each emitter opening 18 in the column direction is typically 150–170 μm. The width of each crosspiece 16 is typically 25–30 μm. The dimension of each emitter opening 18 in the row direction is typically 65–70 μm.

Rails 14 and crosspieces 16 of emitter electrodes 12 are typically of approximately the same thickness. Electrodes 12 typically consist of metal such as an alloy of nickel or aluminum. In this case, the thickness of electrodes 12 is typically 200 nm. Electrodes 12 can alternatively be formed with chromium, gold, silver, molybdenum or another corrosion-resistant metal of high electrical conductivity.

A blanket electrically resistive layer 20 is situated on emitter electrodes 12. Resistive layer 20 extends down to baseplate 10 in emitter openings 18 and in the spaces between emitter electrodes 12. While the configuration of blanket layer 20 may seem to electrically intercouple different emitter electrodes 12, the resistance of such electrical intercoupling is so high that electrodes 12 are effectively electrically insulated from one another. Layer 20 provides a resistance of at least $10^6$ ohms, typically $10^{10}$ ohms, between each emitter electrode 12 and, as described below, each overlying electron-emissive element.

Resistive layer 20 transmits a substantial percentage of the incident backside actinic radiation utilized in fabricating the electron-emitting device of FIGS. 1 and 2. When the backside radiation is UV light, the percentage of UV light that passes directly through layer 20 (i.e., without significant scattering) is generally in the vicinity of 40–80%. For this purpose, layer 20 typically consists of cermet in which particles of a metal such as chromium are embedded in a transparent ceramic such as silicon oxide (silica). The thickness of layer 20 is typically 0.3–0.4 μm.

A transparent dielectric layer 22 overlies resistive layer 20. Dielectric layer 22 typically consists of silicon oxide having a thickness of 0.1–0.2 μm.

A group of laterally separated sets of electron-emissive elements 24 are situated in openings 26 extending through dielectric layer 22. Each set of electron-emissive elements 24 occupies an emission region that wholly overlies a designated region 16D of a corresponding one of crosspieces 16 in each emitter electrode 12. Each designated region 16D is largely row-direction centered on, and of lesser row-direction dimension than, its crosspiece 16. The same applies thus to the emission region for each set of electron-emissive elements 24. Since crosspieces 16 are separated by emitter openings 18, each designated region 16D is located between a consecutive pair of openings 18.

The particular electron-emissive elements 24 overlying each emitter electrode 12 are electrically coupled to that electrode 12 through resistive layer 20. Electron-emissive elements 24 can be shaped in various ways. In the example of FIG. 1, elements 24 are generally conical in shape. When elements 24 are configured as cones, elements 24 typically consist of molybdenum.

A group of composite opaque laterally separated control electrodes 28 are situated on dielectric layer 22. Control electrodes 28 extend generally in the column direction and thus constitute column electrodes. Each control electrode 28 controls one column of subpixels. Three consecutive control electrodes 28 thus control one column of pixels.

Control electrodes 28 cross over emitter electrodes 12 in a generally perpendicular manner. Each control electrode 28 overlies a corresponding one of crosspieces 16 in each emitter electrode 12. Electrodes 28 are symmetrically wider in the regions generally overlying crosspieces 16 than in the regions overlying portions of rails 14 so as to reduce the capacitance associated with electrodes 28. The centerline-to-centerline spacing between the longitudinal centerlines (not shown) of electrodes 28 is relatively constant along their lengths. As a whole, electrodes 28 thus extend generally parallel to one another.

Each control electrode 28 consists of a main control portion 30 and a group of adjoining gate portions 32 equal in number to the number of emitter electrodes 12. Main control portions 30 extend fully across the field emitter in the column direction. Gate portions 32 are partially situated in large control openings 34 extending through main control portions 30 directly above designated regions 16D of crosspieces 16. Electron-emissive elements 24 are exposed through gate openings 36 in the segments of gate portions 32 situated in large control openings 34.

Control openings 34 laterally bound (and therefore define) the emission regions for the laterally separated sets of electron-emissive elements 24. Hence, each control opening 34 is sometimes referred to as a "sweet spot". Designated regions 16D are also defined by large control openings 34. Since three consecutive control electrodes 28 control one pixel column, the three sets of electron-emissive elements 24 in three consecutive large control openings 34 in a row of openings 34 form a pixel in the field emitter.

Gate portions 32 partially overlie main control portions 30 in the example of FIG. 1. Alternatively, main control portions 30 can partially overlie gate portions 32. In either case, gate portions 32 are considerably thinner than main portions 30.

The centerline-to-centerline spacing of control electrodes 28 between the longitudinal centerlines (again, not shown) is typically 90–100 μm. The width of each control electrode 28 typically varies from a maximum of 70–80 μm over designated regions 16D to a minimum of 40–50 μm elsewhere. Main control portions 30 typically consist of chromium having a thickness of 0.2 ||m. Gate portions 32 typically consist of chromium having a thickness of 0.04 μm.

A focusing system 37, generally arranged in a waffle-like pattern as viewed perpendicularly to the upper (interior) surface of faceplate 10, is situated on the parts of main control portions 30 and dielectric layer 22 not covered by control electrodes 28. Referring to FIG. 1, focusing system 37 is formed with an electrically non-conductive base focusing structure 38 and a thin electrically non-insulating focus coating 39 situated over part of base focusing structure 38. Inasmuch as focus coating 39 is thin and generally follows the lateral contour of base focusing structure 38, only the plan view of base structure 38 of focusing system 37 is illustrated in FIG. 2.

Non-conductive base focusing structure 38 normally consists of electrically insulating material but can be formed with electrically resistive material of sufficiently high resistivity as to not cause control electrodes 28 to be electrically coupled to one another. Focus coating 39 normally consists of electrically conductive material, typically a metal such as aluminum having a thickness of 100 nm. The sheet resistance of focus coating 39 is typically 1–10 ohms/sq. In certain applications, focus coating 39 can be formed with electrically resistive material. In any event, the resistivity of focus coating 39 is normally considerably less than that of base focusing structure 38.

Base focusing structure 38 has a group of openings 40, one for each different set of electron-emissive elements 24. In particular, focus openings 40 expose gate portions 32. Focus openings 40 are concentric with, and larger than, large control openings (sweet spots) 34.

In FIG. 2, the greater dimensional compression in the column (vertical) direction than in the row (horizontal) direction causes focus openings 40 to appear longer in the row direction than in the column direction. Actually, the opposite case normally arises. The lateral dimension of openings 40 in the row direction is usually 50–150 $\mu$m, typically 80–90 $\mu$m. The lateral dimension of openings 40 in the column direction is usually 75–300 m, typically 120–140 $\mu$m, and thus is normally significantly greater than the lateral dimension of openings 40 in the row direction.

Focus coating 39 lies on the top surface of base focusing structure 38 and extends partway, typically in the vicinity of up to 50–75% of the way, into focus openings 40. Although non-conductive base focusing structure contacts control electrodes 28, non-insulating focus coating 39 is everywhere spaced apart from control electrodes 28. As viewed perpendicularly to the upper surface of baseplate 10, each different set of electron-emissive elements 24 is laterally surrounded by base focusing structure 38 and therefore by focus coating 39.

Focusing system 37, primarily non-insulating focus coating 39, focuses electrons emitted from each different set of electron-emissive elements 24 so that the emitted electrons impinge on phosphor material in the corresponding light-emissive element of the light-emitting device situated opposite the electron-emitting device. In other words, focusing system 37 focuses electrons emitted from electron-emissive elements 24 in each sub-pixel so as to strike phosphor material in the same sub-pixel. Efficient performance of the electron focusing function requires that focus coating 39 extend considerably above elements 24 and that certain lateral distances from each set of elements 24 to certain parts of focusing system 37, specifically certain parts of coating 39, be controlled well.

More particularly, pixels are typically largely square with the three sub-pixels of each pixel being arranged in a line extending in the row direction. Portions of the active pixel area between rows of pixels are typically allocated for receiving edges of spacer walls. The net result of this configuration is that large control openings 34 are typically considerably closer together in the row direction than in the column direction. Better focus control is thus necessary in the row direction than in the column direction. Accordingly, the critical distances that need to be controlled to achieve good electron focusing are the row-direction distances from lateral edges of focusing system 37 to the nearest edges 34C of large control openings 34. Since edges 34C extend in the column direction, they are referred to here as column-direction edges.

The internal pressure in the final flat-panel display that contains the field emitter of FIGS. 1 and 2 is very low, generally in the vicinity of $10^{-7}$–$10^{-6}$ torr. With baseplate 10 being thin, focusing system 37 also serves as a surface contacted by spacers, typically spacer walls, that enable the display to resist external forces such as air pressure while maintaining a desired spacing between the electron-emitting and light-emitting parts of the display.

The preceding distance and spacer-contact considerations are addressed by configuring base focusing structure 38 as a tall main base portion 38M and a group of opposing pairs of critically aligned further base portions 38L. The two further base focusing portions 38L in each of the opposing pairs of further base portions 38L are situated on opposite sides of a corresponding one of large control openings 34 and thus on opposite sides of a corresponding one of the sets of electron-emissive elements 24. As shown in FIG. 1, further base focusing portions 38L are slightly shorter than main base focusing portion 38M. Parts of focus coating 39 extend partway down the side surfaces of shorter focusing portions 38L into focus openings 40.

The portions of focus coating 39 overlying each pair of opposing shorter base focusing portions 38L in focus openings 40 are situated at well-controlled row-direction distances from the corresponding set of electron-emissive elements 24. Specifically, each pair of opposing shorter focusing portions 38L have lateral edges 38C vertically aligned to portions 28C of the outer lateral longitudinal edges 30 of the particular control electrode 28 that controls the corresponding set of electron-emissive elements 24. Similar to column-direction edges 34C of large control openings 34, focusing-structure edges 38C extend in the column direction and are referred to here as column-direction edges.

The row-direction distances from each pair of control-electrode longitudinal edge portions 28C, and therefore from the corresponding pair of focusing-structure column-direction edges 38C, to the column-direction edges 34C of large control opening 34 for the corresponding set of electron-emissive elements 24 are, as described below, determined by fixed photomask dimensions and are therefore well controlled. Since focus coating 39 extends partway down the sides of shorter focusing portions 38L into focus openings 40, the portions of focus coating 39 overlying each pair of opposing focusing portions 38L are spaced apart the corresponding set of electron-emissive elements 24 by well-controlled row-direction distances. Important in achieving these well-controlled row-direction spacings is the fact that control-electrode edge portions 28C, and thus focusing-structure column-direction edges 38C, overlie emitter openings 18.

The full plan-view configuration of base focusing structure 38 with respect to electrodes 28 and 12 can be seen in FIG. 4 oriented the same as FIG. 2. FIG. 4 depicts two emitter electrodes 12. Item 42 in FIG. 4 indicates the area between each pair of consecutive electrodes 12. During display assembly, spacer walls are brought into contact with parts of focus coating 39 overlying main focusing portion 38M generally along some or all of areas 42. If desired, strips of main focusing portion 38M above spacer-contact areas 42 can be replaced with focusing material that extends to approximately the same height as shorter focusing portions 38L so as to provide grooves in base focusing portion 38, as covered there with focus coating 39, for receiving edges of the spacer walls.

Base focusing structure 38 is normally created from negative-tone electrically insulating actinic material which is selectively exposed to actinic radiation and developed. The actinic material is preferably photo-polymerizable polyimide, typically Olin OCG7020 polyimide. Main focusing portion 38M typically extends 45–50 $\mu$m above dielectric layer 22. Further focusing portions 38L are normally 10–20% shorter than main portion 38M.

During display operation, a suitable potential is applied to focusing system 37, specifically to focus coating 39 to control the electron focusing. The focus control potential is of such a value, typically 25–50 volts relative to ground, so as to cause electrons emitted from each set of electron-emissive elements 24 to be focused on the corresponding (directly opposite) phosphor region in the light-emitting device.

The field emitter of FIGS. 1–4 is fabricated in the following manner. A blanket layer of the emitter-electrode material is deposited on baseplate 10 and patterned using a suitable photoresist mask to produce ladder-shaped emitter electrodes 12. Resistive layer 20 is then deposited on top of the structure. Dielectric layer 22 is deposited on top of resistive layer 20.

A blanket layer of the electrically conductive material for main control portions 30 is deposited on layer 22 and patterned using a suitable photoresist mask to form main control portions 30, including large control openings 34. The photoresist mask is created by exposing a blanket layer of positive-tone photoresist to UV light selectively through a photomask (reticle) bearing a light-blocking pattern that corresponds to the desired pattern of main control portions 30. The row-direction distances from each pair of control-electrode longitudinal edge portions 28C to column-direction edges 34C of large control opening 34 for the corresponding set of electron-emissive elements 24 are established by fixed row-direction dimensions in this photomask. These photomask dimensions are largely the same for every control opening 34. As a result, the resulting row-direction distances from each pair of control-electrode edge portions 28C to column-direction edges 34C of the corresponding control opening 34 are well controlled.

Also, the photomask dimensions that define the distances from each pair of control-electrode edge portions 28C to the corresponding pair of control-opening column-direction edges 34C are largely the same on both sides of each control opening 34. Accordingly, each control-opening sweet spot 34 is row-direction centered in its control electrode 28.

The dimension of control openings 34 in the row direction is determined by the magnitude of the row direction distance across which electrons emitted by a set of electron-emissive elements 24 can be focused by focusing system 37 to strike the intended light-emissive element in the light emitting device. For instance, an electron emitted from an electron-emissive element 24 at the row-direction center of a focus opening 40 can readily be focused to strike the intended light-emissive element. On the other hand, an electron emitted from an electron-emissive element situated along either focusing-structure column-direction edge 38C of a focus opening 40 can generally not be regularly focused to strike the intended light-emissive element.

Subject to each control opening 34 being row-direction centered in its control electrode 28, the row-direction dimension of control openings 34 is generally in the range of 5–50% of the row-direction dimension of focus openings 40. More particularly, the control-opening row-direction dimension is 15–25%, typically 20%, of the focus-opening row-direction dimension.

A blanket layer of the gate material is deposited on top of the structure and patterned using another photoresist mask to form gate portions 32. If gate portions 32 are to underlie segments of main control portions 30 rather than overlie segments of main control portions 30, the last two deposition/patterning operations are reversed.

At this point, various manufacturing techniques and sequences can be utilized to form dielectric openings 26, electron-emissive elements 24, and focusing system 37. The common thread among all of these techniques and sequences is that base focusing structure 38 is normally created by a process involving (a) backside exposure of actinic material to actinic radiation using emitter electrodes 12 and control electrodes 28 as a radiation-blocking mask, (b) frontside exposure of the actinic material through a suitable photomask, and (c) removal of the unexposed actinic material in a development operation.

In one example, gate openings 36 and dielectric openings 26 are created respectively in gate portions 32 and dielectric layer 22 according to a charged-particle tracking procedure of the type described in U.S. Pat. Nos. 5,559,389 or 5,564,959. The contents of these two patents are incorporated by reference herein. Electron-emissive elements 24 are created as cones by depositing electrically conductive material through gate openings 36 and into dielectric openings 26 according to a deposition technique of the type described in either of these patents. As result, electron-emission elements 24 in each set of elements 24 are situated at random locations relative to one another.

Figure 5A:
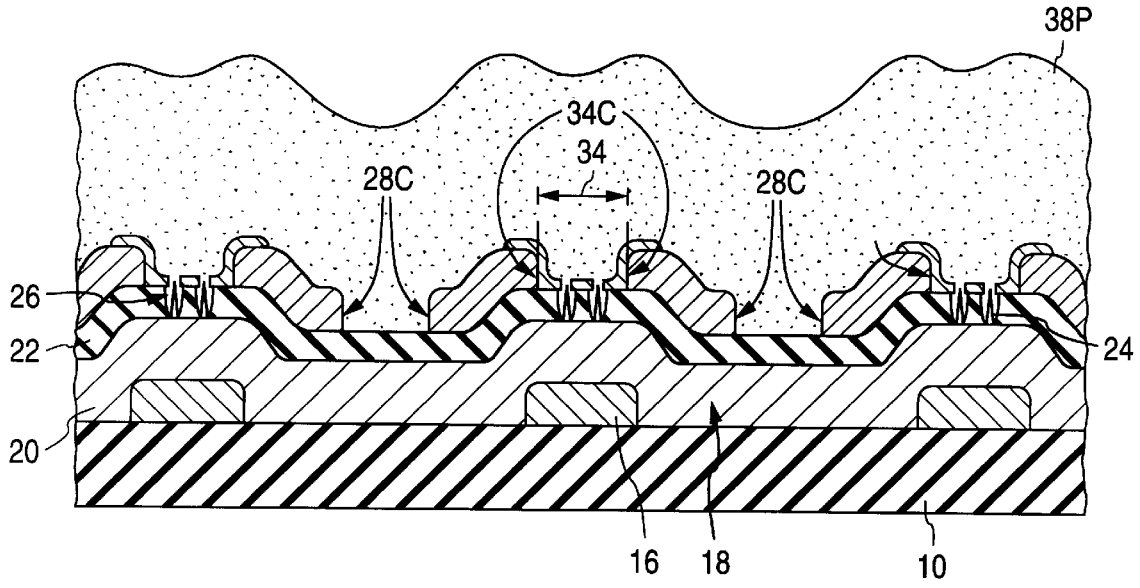
FIGS. 5*a*–5*d* are cross-sectional side views representing steps that employ the invention's teachings in manufacturing the base focusing structure of the electron-emitting device in FIGS. 1, 2, and 4.
Figure 5B:
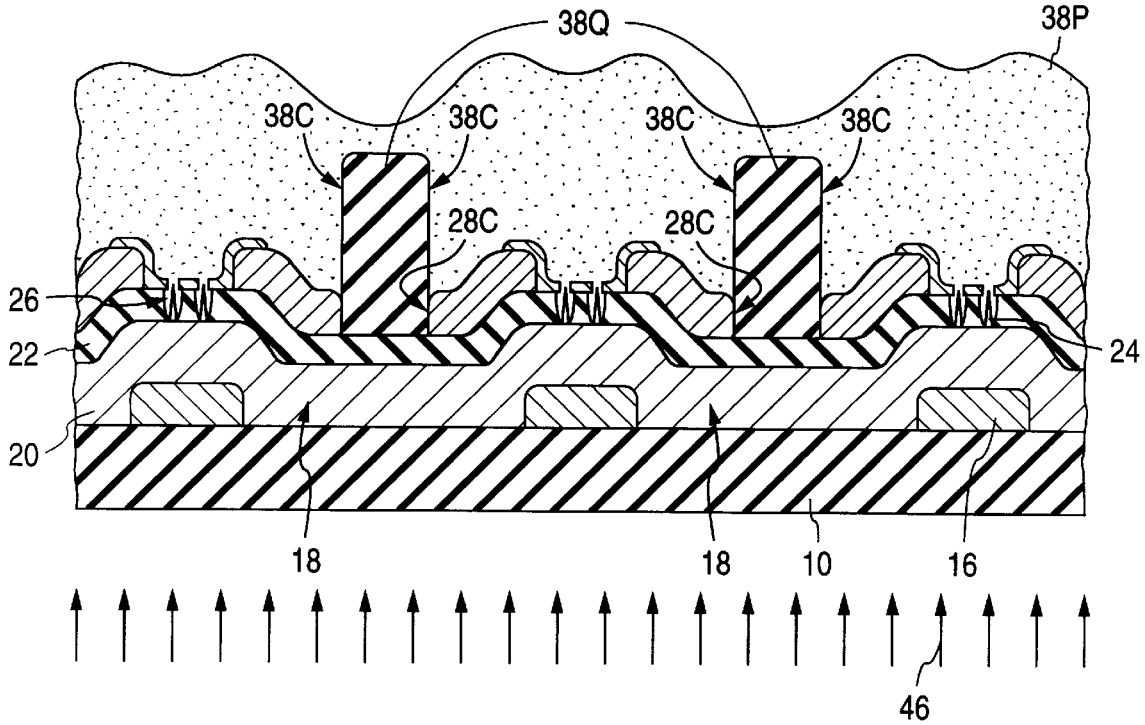
Figure 5C:
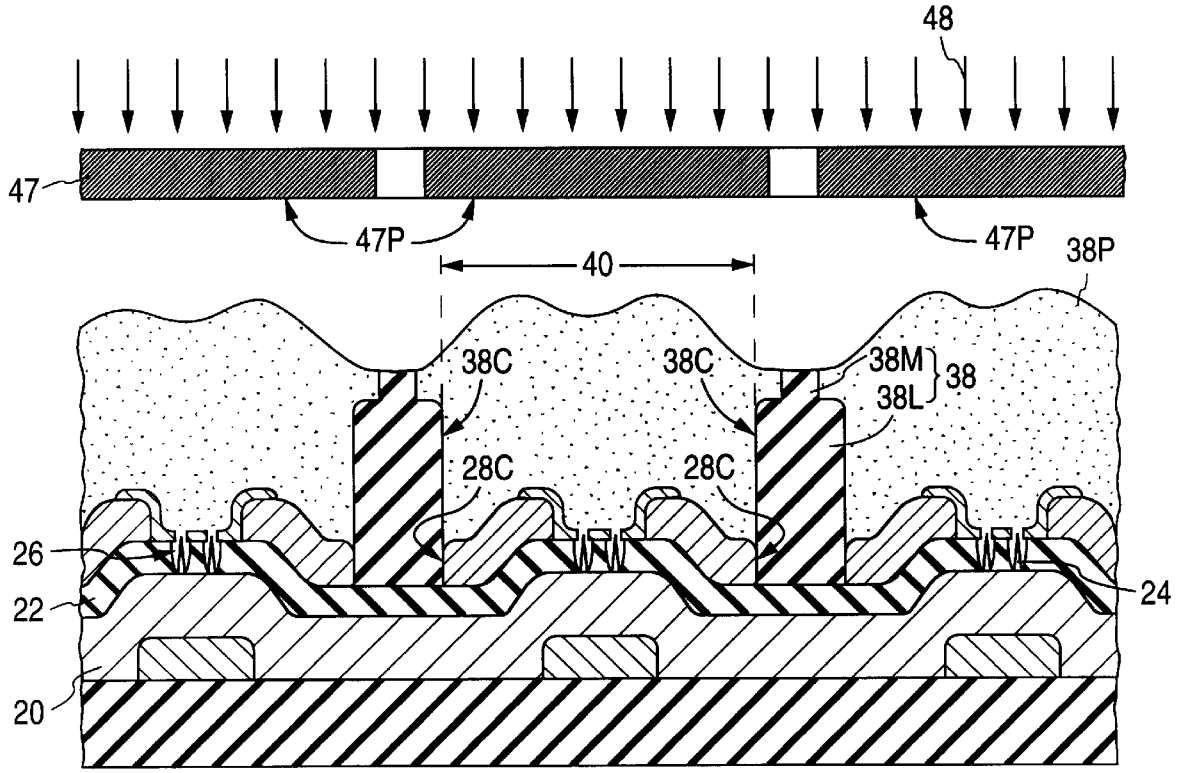

Base focusing structure 38 is now formed as illustrated in FIGS. 5*a*–5*d*. A primary blanket layer 38P of negative-tone electrically insulating actinic material is provided on top of the structure to a thickness sufficient to produce main base focusing portion 38M. The electron-emitting structure is subjected to backside actinic radiation 46 that impinges perpendicularly on the lower (exterior) surface of faceplate 10 as shown in FIG. 5*b*. Baseplate 10 is largely transmissive of backside radiation 46. Accordingly, radiation passes through baseplate 10 traveling from its lower surface to its upper (interior) surface.

Electrodes 12 and 28 are largely non-transmissive of backside radiation 46. Resistive layer 20 directly transmits a substantial percentage of radiation 46, typically in the vicinity of 40–80% of radiation 46 as mentioned earlier. Dielectric layer 22 largely transmits radiation 46. Hence, the portion 38Q of primary actinic layer 38P not shadowed by a radiation-blocking mask formed with electrodes 12 and 28 is exposed to radiation 46 and changes chemical structure.

Importantly, backside radiation 46 passes through openings 18 in emitter electrodes 12. Segments of control electrodes 28, specifically segments of main control portions 30, extending up to portions 28C of the longitudinal edges of electrodes 28 overlie emitter openings 18. As a result, sections of primary layer 38P vertically aligned with lateral control-electrode edges 28C are exposed to radiation 46 to define column-direction lateral edges 38C of base focusing structure 38.

The partially finished electron-emitting structure is now subjected through a photomask 47 to frontside actinic radiation 48 that impinges perpendicularly on top of the electron-emitting structure. See FIG. 5*c*. Photomask 47 has radiation-blocking areas 47B at regions above focus openings 40. Radiation-blocking areas 47B are slightly larger than openings 40 in the row direction. Each of blocking areas 47B corresponds to the region indicated by horizontal arrow 44 and vertical arrow 40 in FIG. 2 or 4. Material of primary layer 46 not shadowed by blocking areas 47B is exposed to frontside radiation 48 and changes chemical structure.

The order in which the backside and frontside exposures are performed is generally immaterial. Accordingly the backside exposure can be performed after the frontside exposure. When the actinic material is photo-polymerizable polyimide, such as Olin OCG7020 polyimide, the actinic radiation during both the backside and frontside exposures is typically UV light. Upon being exposed to the UV light, the polyimide changes chemical structure by undergoing polymerization.

Figure 5D:
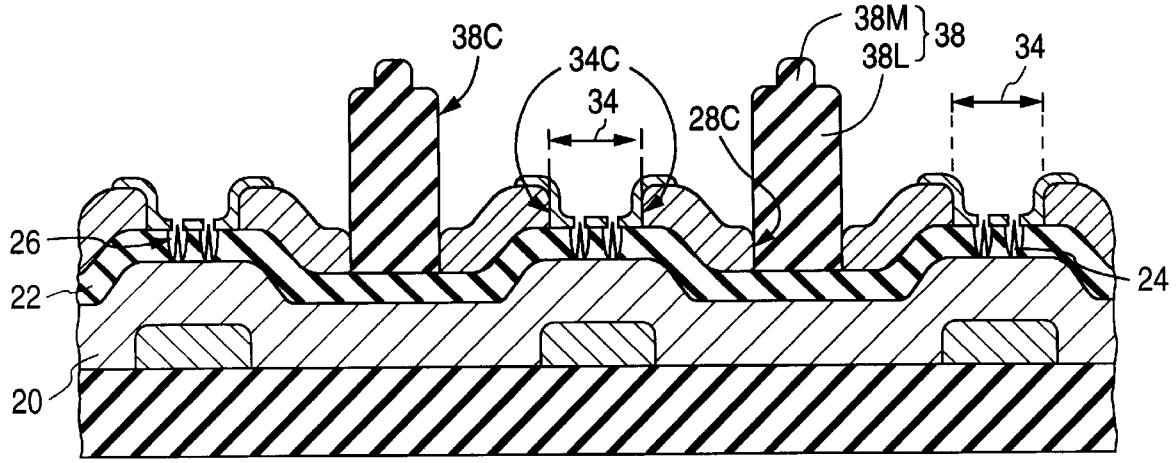

A development operation is performed to remove the unexposed portions of primary layer 38P, thereby producing base focusing structure 38 as shown in FIG. 5*d*. Due to the presence of baseplate 10, backside radiation 46 normally did not fully penetrate primary layer 38P at the backside exposed areas. Since further base focusing portions 38L were only exposed to backside radiation 46, further focusing portions 38L are normally shorter than main focusing portion 38M. If backside radiation 46 fully penetrates primary actinic layer 46P, the height differential between focusing portions 38M and 38L is reduced or, with sufficient backside exposure, eliminated.

Focus coating 39 is formed over base focusing structure 38, typically by performing a suitably angled evaporation of the focus-coating material. The angled evaporation can be done in the manner described in Haven et al, co-filed U.S. patent application Ser. No. 08/866,554, the contents of which are incorporated by reference herein.

During fabrication of the field emitter of FIGS. 1 and 2, focusing system 37 is provided with one or more electrical conductors (not shown) which contact focus coating 39 and through which focusing system 37 is externally accessed for providing the focus control potential to focus coating 39. The access conductor or conductors are typically configured and fabricated as described in Barton et al, co-filed U.S. patent application Ser. No. 08/866,151, the contents of which are incorporated by reference herein. This completes the formation of focusing system 37, thereby yielding the field-emitter of FIGS. 1 and 2.

In subsequent operations, the field emitter is sealed to the light-emitting device through an outer wall. The sealing operation typically entails mounting the outer wall and the spacer walls on the light-emitting device. This composite assembly is then brought into contact with the field emitter and hermetically sealed in such a manner that the internal display pressure is typically $10^{-7}$–$10^{-6}$ torr. The spacer walls contact focusing system 37 along part or all of areas 42 in FIG. 4.

An alternative way of processing negative-tone primary actinic layer 38P to produce a base focusing structure similar to base structure 38 involves first exposing primary layer 38P to frontside actinic radiation 48 through a photomask having radiation-blocking stripes that extend in the row direction fully across the display's intended active area. Each row-direction radiation-blocking stripe overlies the intended locations for (a) a row of focus openings 40 and (b) the intervening generally rectangular primary actinic strips situated between the intended locations for focus openings 40 in that row. These rectangular primary actinic strips extend longitudinally in the column direction. Frontside radiation 48 fully penetrates layer 38P at the exposed areas, causing the so-exposed actinic material below the row-direction radiation-blocking stripes to change chemical structure.

The exposure with backside radiation 46 is now performed so that radiation 46 partially penetrates primary layer 38P at the exposed areas. The only unexposed primary actinic material subjected to radiation 46 (and thus not shadowed by the mask formed with electrodes 12 and 28) consists of the rectangular column-direction primary actinic strips situated between the intended locations for focus openings 40 in each focus opening row. Consequently, the exposed material of primary layer 38P has column-direction edges vertically aligned to portions of control-electrode column-direction edges 28C generally at the locations for column-direction focus edges 38C in FIGS. 1 and 2.

Primary layer 38P is now developed to remove the unexposed actinic material. The exposed remainder of layer 38P forms the base focusing structure. Because backside radiation 46 only partially penetrated primary layer 38P at the backside-exposed areas, the height of the full widths of the column-direction rectangular focusing strips between focus openings 40 is both largely uniform and less than the height of the remainder of the base focusing structure. Except for this and the fact focus openings 40 here are, in plan view, more rectangular than focus openings 40 in FIG. 2, the shape of the base focusing structure is generally the same as that shown for base structure 38 in FIGS. 1 and 2.

As with the backside exposure in the process of FIGS. 5*a*–5*d*, the backside exposure in this alternative process can be performed under such conditions that backside radiation 46 fully penetrates primary actinic layer 38P at the exposed areas. The height differential between (a) the column-direction rectangular focusing strips situated between focus openings 40 in each focus opening row and (b) the remainder of the base focusing structure is then reduced or eliminated.

The base focusing structure is provided with an electrically non-insulating focus coating analogous to focus coating 39 to form a composite focusing structure similar to focusing system 37. The focus coating typically consists of electrical conductive material evaporatively deposited in the manner described above for focus coating 39. The resultant field emitter appears generally as shown in FIGS. 1 and 2 subject to the above-mentioned focusing structure differences.

Instead of creating a base focusing structure from negative-tone actinic material, a base focusing structure similar to base structure 38 can be formed from non-actinic electrically non-conductive material using positive-tone actinic material, typically photoresist, combined with a lift-off step to achieve self-alignment to control-electrode edge portions 28C. Specifically, the process described above for creating base structure 38 is modified by providing a primary blanket layer of positive-tone photoresist on top of the partially finished field emitter directly after removing the portion of the blanket layer of emitter cone material at the desired location for base structure 38.

The exposures with backside actinic radiation 46 and frontside actinic radiation 48 are then performed. Emitter electrodes 12 and control electrodes 28 form a mask that prevents the directly overlying portions of the blanket photoresist layer from being exposed to backside radiation 46. The exposed portion of the primary photoresist layer changes chemical structure. Radiation 46 and radiation 48 are both normally UV light. Either radiation exposure can be done first.

A development operation is conducted on the primary photoresist layer. Because the photoresist is positive-tone actinic material, the exposed material of the photoresist layer is removed during the development operation. In plan view, the remaining photoresist consists of portions having substantially the reverse configuration of base focusing structure 38 in FIGS. 1 and 2. Due to the backside exposure, sections of the remaining photoresist have lateral edges vertically aligned with control-electrode edge portions 28C.

A blanket layer of non-actinic electrically non-conductive material, typically an electrical insulator such as spin-on glass, is formed on top of the structure. The remaining portions of the primary photoresist layer are removed so as to lift off the overlying portions of the blanket non-actinic non-conductive layer. The remainder of the non-actinic non-conductive layer forms a base focusing structure configured substantially the same as base focusing structure 38 except that the height difference between main portion 38M and shorter portions 38L is not present. In particular, the base focusing structure created from the non-actinic non-conductive material has pairs of opposing lateral column-direction edges vertically aligned with control-electrode edge portions 28C. Consequently, the row-direction spacings from each of these pairs of focusing-structure column-direction edges to column-direction edges 34C of the corresponding control-opening sweet spot 34 are well controlled.

An electrically non-insulating focus coating, typically an electrical conductor analogous to focus coating 39, is formed on the base focusing structure to create a composite focusing structure analogous to focusing system 37. The non-conductive base focus structure has a considerably higher resistivity than the non-insulating focus coating. The resulting field emitter appears generally as shown in FIGS. 1 and 2 except that the composite focusing structure is of largely uniform height.

A variation of the foregoing process employs positive-tone actinic material in creating another focusing system similar to focusing system 37 except that largely the entire focusing system consists of electrically non-insulating material, typically electrically conductive material, spaced apart from control electrodes 28. Since the focusing system is typically electrically conductive, there is no need to provide a separate electrically non-insulating focus coating corresponding to focus coating 39. This variation begins with the structure existent after the portion of the blanket layer of emitter conductive material has been removed at the desired location for base focusing structure 38 so that portions of control electrodes 28 are uncovered.

A layer of electrically non-conductive material, typically an electrical insulator, transmissive of backside radiation 46 is provided on at least the uncovered sections of the lateral edges of control electrodes 28. The non-conductive layer is normally a blanket layer that fully covers the previously uncovered portions of electrodes 28 and the portions of dielectric layer 22 between those portions of electrodes 28. A primary blanket layer of positive-tone photoresist is provided on top of the non-conductive layer. The blanket photoresist layer lies on any material of electrodes 28 and/or dielectric layer 22 not covered by the non-conductive layer.

The exposures with radiation 46 and 48 are now performed. Electrodes 12 and 28 again form a mask that shields the overlying portions of the positive-tone photoresist from backside radiation 46. Since the non-conductive layer is transmissive of radiation 46, exposed photoresist of changed chemical structure is produced in largely the same pattern as in the foregoing process that employs positive-tone photoresist at this point. The primary photoresist layer is developed to remove the exposed photoresist material. Sections of the remaining photoresist thus have lateral edges vertically aligned to the outside sections of the surfaces of the non-conductive material covering the sections of the lateral edges of control electrodes 28.

A blanket layer of electrically non-insulating material, typically an electrical conductor, is formed on top of the structure. The remaining portions of the primary photoresist layer are removed so as to lift off the overlying portions of the blanket non-insulating layer. The remainder of the blanket non-insulating layer forms an electrically non-insulating focusing structure of substantially the same configuration as base focusing structure 38 except that the height differential between portions 38M and 38L is again eliminated. The non-insulating focusing structure has pairs of opposing lateral column-direction edges vertically aligned to the outside surface sections of the non-conductive material covering the lateral edge sections of control electrodes 28. Accordingly, the pairs of opposing lateral column-direction edges of the focusing structure are self-aligned to control-electrode edge portions 28C. The row-direction spacings from each of these pairs of focusing-structure column-direction edges to column-direction edges 34C of the corresponding sweet spot 34 are again well controlled.

If any of the remaining non-conductive material covers the top surface sections of control electrodes 28, an etch is performed to remove this part of the non-conductive material. In the resulting field emitter, the non-insulating focusing structure forms an electron focusing system separated from control electrodes 28 by sections of non-conductive material and/or open spaces. To the extent that any of the non-conductive material separates the focusing system from electrodes 28, the resistivity of the non-conductive material is sufficiently high that the focusing system is effectively electrically insulated from electrodes 28.

Another variation of the foregoing process that employs positive-tone active actinic material in creating a focusing system consisting largely of electrically non-insulating material begins with the structure existing after the non-conductive layer is provided on at least the lateral edges of control electrodes 28. A thin blanket seed metal layer is deposited on top of the structure. If any of the seed metal layer contacts control electrodes 28, the seed metal is normally selectively etchable with respect to the control-electrode material. The seed layer is of such characteristics as to largely transmit backside actinic radiation 46.

A primary blanket layer of positive-tone photoresist is provided on top of the seed metal layer. The exposures with radiation 46 and 48 are performed. Electrodes 12 and 28 form a mask that prevents the directly overlying photoresist from being exposed to backside radiation 46. Since the seed layer transmits radiation 46, the exposed photoresist of changed chemical structure has largely the same pattern as in the two foregoing process variations.

The exposed photoresist portions are removed in a development step. Accordingly, sections of the remaining photoresist again have lateral edges vertically aligned to the outside surface sections of the non-conductive material covering the lateral edge sections of control electrodes 28. Also, a pattern of the seed metal layer is now exposed at the location of removed photoresist.

A focus structure metal is electrochemically deposited (electroplated) into the patterned opening in the remaining photoresist, using the exposed seed metal to initiate the electrochemical deposition. The deposition is terminated before the focus structure metal reaches the top of the photoresist. The remaining photoresist is removed after which the exposed seed metal is removed. The remainder of the focus structure metal forms an electrically non-insulating focusing structure, specifically an electrically conductive focusing structure, configured substantially the same as in the immediately previous process variation. Pairs of opposing lateral column-direction edges of the metal focusing structure are thus self-aligned to control-electrode edge portions 28C.

Processing of the field emitter in this variation is then continued in the same manner as in the foregoing process variation. In the final field emitter, the electron focusing system formed with the metal focusing structure is separated from control electrodes 28 by open spaces and/or sections of non-conductive material. The resistivity of any non-conductive material separating electrodes 28 from the focusing system is sufficiently high that the focusing system is effectively electrically insulated from electrodes 28.

Short-circuit defects can occur between control electrodes 28, on one hand, and emitter electrodes 12, on the other hand, during fabrication of the present electron-emitting device. Moving to FIG. 6, it qualitatively illustrates an example of a short circuit between one control electrode 28 and one emitter electrode 12 in a segment of the portion of the field emitter shown in FIG. 1. The cross section of FIG. 6 is taken in the column direction through one of crosspieces 16. The illustrated short circuit is directly formed by electrically conductive material 50 that extends through dielectric layer 22 and resistive layer 20 to connect the illustrated control electrode 28 to the illustrated crosspiece 16 in emitter electrode 12. Although conductive material 50 is shown as being distinct from column electrode 28, conductive material 50 may consist of part of the conductive material employed to create electrodes 28.

Occasionally, one of electron-emissive elements 24 in one of the sets of elements 24 becomes electrically connected to corresponding gate portion 32. If resistive layer 20 were absent, such an electrical connection might be classified as a short circuit. However, due to the high resistance that layer 20 provides between crosspieces 16 and overlying electron-emissive elements 24, the amount of current that can flow through column electrode 28 due to one of its electron-emissive elements 24 being connected to gate portion 32 is extremely small compared to the current that flows through a direct short circuit such as that represented by conductive material 50. Accordingly, the electrical connection of gate portion 32 to one of its electron-emissive elements 24 is not classified here as a short circuit.

A short circuit of one control electrode 28 to one emitter electrode 12 can occur at any one of three basic places on that emitter electrode 12: (a) at crosspiece 16 underlying column electrode 28, (b) at the portion of one of rails 14 underlying electrode 28, and (c) at a portion of the other rail 14 underlying electrode 28. This is qualitatively shown in FIG. 7 which presents a partial plan view of a segment of the portion of the field emitter depicted in FIG. 6. Short-circuit case (a), corresponding to conductive material 50 in FIG. 6, is represented by circled "X" 52 in FIG. 7. Short-circuit cases (b) and (c) at locations on rails 14 are represented by circled "Xs" 54 and 56.

Short circuits are typically detected during testing of the electron-emitting device subsequent to fabrication but before the device is sealed (through an outer wall) to the light-emitting device to form the flat-panel display. When done at this stage, a short-circuit defect can often be removed from the electron-emitting device. This is sometimes referred to as short-circuit repair. Removing or repairing short-circuit defects increases the yield of good flat-panel displays and thus is important to device fabrication and test.

Ideally, a short-circuit defect is removed in such a manner that no loss in performance is incurred. Nonetheless, display performance is often satisfactory when a few pixels or sub-pixels are partially or totally inoperative, provided that the remainder of the flat-panel display operates in the intended manner. Accordingly, removing a short-circuit defect in a way that causes a pixel or sub-pixel to be inoperative is often acceptable, again provided that the operation of the remainder of the display is largely unaffected and also provided that the number of removed short-circuit defects is not too high.

Figure 7:
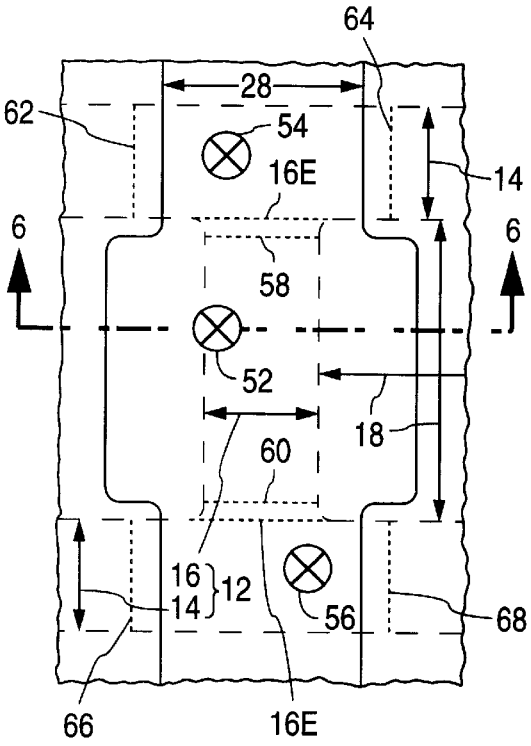
FIG. 7 is a plan view of a short-circuited segment of the portion of the electron-emitting device in FIG. 6.

The ladder shape of each emitter electrode 12 facilitates removal of short-circuit defects from the present field emitter without causing its performance to be impaired except that the sub-pixel at the site of the short-circuit defect sometimes becomes inoperative. FIG. 7 is helpful in understanding how short-circuit defects are removed from the field emitter of the present invention.

Assume that a short-circuit defect at the site represented by circled "X" 52 has been detected. As indicated in FIG. 7, short-circuit defect 52 occurs on crosspiece 16. Defect 52 is removed by making a pair of cuts 58 and 60 fully through the width of crosspiece 16 on opposite sides of defect 52. The segment of crosspiece 16 between cuts 58 and 60 is thus disconnected from the remainder of emitter electrode 12.

Any electron-emissive elements 24 overlying the disconnected segment of crosspiece 16 are normally disabled. As a result, part or all of the sub-pixel containing that crosspiece 16 becomes inoperative. However, the operation of the remainder of emitter electrode 12 is not significantly affected. With rails 14 being fully intact, voltage for controlling all of the sets of electron-emissive elements 24 overlying electrode 12 can be transmitted down the full length of electrode 12.

Cuts 58 and 60 are typically made at predetermined locations near ends 16E of crosspiece 16. In this case, crosspiece 16 is fully disconnected from the remainder of emitter electrode 12. The removal of short-circuit defect 52 then results in the loss of the entire sub-pixel containing disconnected crosspiece 16. Again, rails 14 remain fully intact. Hence, the normal operation of the remainder of emitter electrode 12 is not significantly affected by the removal of short-circuit defect 52.

For convenience, let the two rails 14 of emitter electrode 12 in FIG. 7 be respectively referred to as the higher and lower rails, where the higher rail is the top one of rails 14 in FIG. 7, and the lower rail is the bottom one of rails 14 in FIG. 7. With these definitions in mind, assume that a short-circuit defect has been detected at a site represented by circled "X" 54. Short-circuit defect 54 occurs on the portion of higher rail 14 underlying column electrode 28. Defect 14 is removed by making three cuts 58, 62, and 64 through parts of emitter electrode 12 surrounding defect 54. Cut 58 is again made through crosspiece 16 near the higher one of ends 16E. Cuts 62 and 64 are made through higher rail 14 on opposite sides of defect 54 just beyond the area where column electrode 28 overlies higher rail 14. Cuts 62 and 64 can be made at locations predetermined for making cuts 62 and 64 should a short-circuit defect be detected at a site represented by circled "X" 54.

The section of higher rail 14 underlying column electrode 28 is disconnected from the remainder of emitter electrode 12 due to cuts 58, 62, and 64. However, none of electron-emissive elements 24 underlies the disconnected section of rail 14. Provided that a segment of lower rail 14 is not similarly removed in either of the directly adjoining sub-pixels on emitter electrode 12, voltage for the sub-pixel containing the removed segment of higher rail 14 can be provided through the segment of lower rail 14 underlying column electrode 28. Hence, the sub-pixel is still operative. Also, the normal operation of the remainder of emitter electrode 12 is not significantly affected by removing short-circuit defect 54 in this way.

Should a short-circuit defect be detected at a site represented by circled "X" 56, a removal procedure symmetrical to that described for short-circuit defect 54 is performed. In particular, three cuts 60, 66, and 68 are made through parts of emitter electrode 12 surrounding short-circuit defect 56. Cut 60 is again made through crosspiece 16 near the lower one of ends 16E. Cuts 66 and 68 are made through lower rail 14 on opposite sides of defect 56 just beyond the area where column electrode 28 overlies lower rail 14. As with the locations for 62 and 64, the locations for cuts 66 and 68 can be predetermined.

For reasons complementary to those given above with respect to short-circuit defect 54, the sub-pixel that contains the disconnected section of lower rail 14 remains operative despite the removal of defect 56, provided that a segment of higher rail 14 is not similarly removed from either of the directly adjoining sub-pixels on emitter electrode 12. Also, removal of short-circuit defect 56 in this way does not significantly affect the operation of the remainder of emitter electrode 12.

Removing any of short-circuit defects 52–56 in the preceding manner does not significantly affect the operation of column electrode 28. Subject to the occasional loss of part or all of the sub-pixel, the performance of the display is not significantly degraded. Rails 14 provide redundant current/voltage paths for overcoming short-circuit defects.

Cuts 58–68 are made with a beam of focused energy, typically optical energy provided by a laser. Cuts 62–68 can be made through the top or bottom of the electron-emitting device. Since column electrode 28 overlies the location for cuts 58 and 60, cuts 58 and 60 are made through the bottom of the device when the cutting is done with a focused energy beam.

Figure 8:
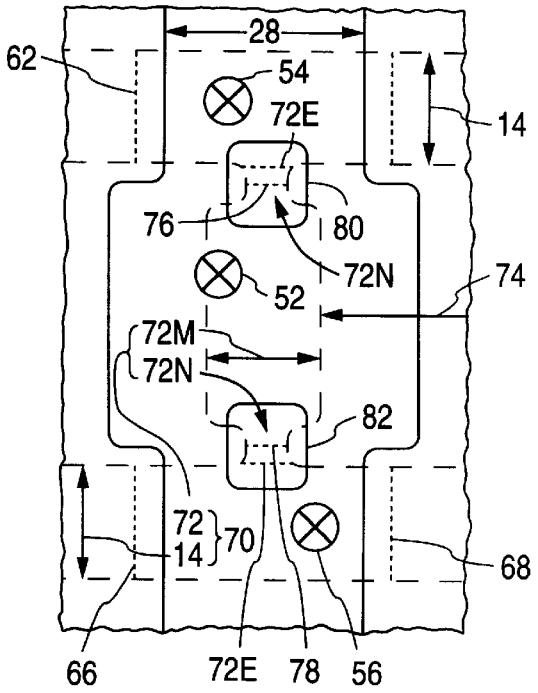
FIG. 8 is a plan view of a short-circuited segment of another general configuration of a ladder-shaped emitter electrode in accordance with the invention.

FIG. 8 presents a plan view that illustrates how the present ladder-shaped emitter electrode can be varied to simplify short-circuit removal in a field-emission electron-emitting device fabricated according to the invention. The plan view of FIG. 8 is the same as that of FIG. 7 except that (a) emitter electrode 12 is replaced with emitter electrode 70 in the field emitter of FIG. 8 and (b) column electrode 28 is modified in the field emitter of FIG. 8. Each emitter electrode 70 consists of a pair of rails 14 and a group of generally parallel crosspieces 72 situated between, and extending generally perpendicular to, rails 14. Rails 14 in the field emitter of FIG. 8 are configured in the manner described above. Each crosspiece 72 has a pair of ends 72E that merge seamlessly into rails 14.

The difference between crosspiece 72 and crosspiece 16 is that crosspiece 72 necks down close to ends 72E. As shown in FIG. 8, crosspiece 72 consists of a main portion 72M and a pair of narrower portions 72N through which main portions 72M is connected to rails 14. Emitter openings 18 in the field emitter of FIG. 7 are replaced with emitter openings 74 in the field emitter of FIG. 8. Due to the necking down of crosspieces 72, each emitter opening 74 is generally rectangular in shape with protrusions at the four corners. Emitter openings 74 are oriented longitudinally in emitter electrode 70.

In variously removing short-circuit defects 52–56 from the electron-emitting device of FIG. 8, cuts 76 and 78 are respectively made through necked-down portions 72N near ends 72E of crosspiece 72. Cuts 76 and 78 are shorter than cuts 58 and 60 in the field emitter of FIG. 7. Aside from this difference, selectively making cuts 62–68, 74, and 76 to variously remove short-circuit defects 52–56 in the field emitter on FIG. 8 is performed in the same way that cuts 58–68 are selectively made to remove defects 52–56 in the field emitter of FIG. 7.

In the field emitter of FIG. 8, a pair of further openings 80 and 82 preferably extend through each column electrode 28 respectively above the predetermined locations for cuts 76 and 78. Further openings 80 and 82 overlie largely all of necked-down portions 72N of crosspiece 72 in the example of FIG. 8. Using a focused energy beam, cuts 76 and 78 can be made through the top or bottom of the electron-emitting device. This provides additional flexibility. Also, when cuts 76 and 78 are made through the bottom of the field emitter, the presence of further openings 80 and 82 helps prevent damage that might otherwise occur to column electrode 28 due to the penetration of the focused energy beam through crosspiece 72 and into electrode 28.

A flat-panel CRT display containing an electron-emitting device manufactured according to the invention operates in the following way. The anode in the light-emitting device is maintained at high positive potential relative to control electrodes 28 and emitter electrodes 12 or 70. When a suitable potential is applied between (a) a selected one of control electrodes 28 and (b) a selected one of emitter electrodes 12 or 70, the so-selected gate portion 32 extracts electrons from the selected set of electron-emissive elements 24 and controls the magnitude of the resulting electron current. Desired levels of electron emission typically occur when the applied gate-to-cathode parallel-plate electric field reaches 20 volts/$\mu$m or less at a current density of 0.1 mA/cm$^2$ as measured at the light-emissive elements when they are high-voltage phosphors. The extracted electrons pass through the anode layer and selectively strike the phosphor regions, causing them to emit light visible on the exterior surface of the light-emitting device.

Directional terms such as "top", "bottom", "upper", and "lower" have been employed in describing the present invention to establish a frame of reference by which the reader can more easily understand how the various parts of the invention fit together. In actual practice, the components of the present electron-emitting device may be situated at orientations different from that implied by the directional items used here. The same applies to the way in which the fabrication steps are performed in the invention. Inasmuch as directional items are used for convenience to facilitate the description, the invention encompasses implementations in which the orientations differ from those strictly covered by the directional terms employed here.

While the invention has been described with reference to particular embodiments, this description is solely for the purpose of illustration and is not to be construed as limiting the scope of the invention claimed below. For instance, the ladder shape of the emitter electrodes of the invention can differ more from a conventional ladder shape than that of emitter electrodes 70. In general, each emitter electrode can be shaped like a bar with the line of emitter openings situated longitudinally relative to the bar. The emitter openings can have plan-view shapes other than rectangles, as with openings 18, or near rectangles, as with openings 74. The bar can have a curved centerline such that the line of emitter openings is similarly curved.

The frontside exposure can be deleted in fabricating the electron-emitting device of the invention, especially when base focusing structure 38 is not utilized to contact spacers such as spacer walls through conductive focus coating 39. On the other hand, multiple frontside exposures can be performed on the actinic material utilized to make base structure 38, each frontside exposure normally being performed through a different photomask. Likewise, multiple backside exposures can be performed on the actinic material employed to create structure 38. In this case, each additional backside exposure is performed through a photomask, different photomasks normally being employed when there are two or more additional backside exposures.

Additional radiation-blocking features can be provided over dielectric layer 20 for use in combination with, or as substitutes for, control electrodes 28 in blocking part of the backside actinic radiation that passes through emitter openings 18 or 74 during the formation of base focusing structure 38. Multiple layers of actinic material can be utilized in forming base structure 38.

The backside exposure through the area not shadowed by control electrodes 28 and emitter electrodes 12 or 70 can be employed in forming a self-aligned structure other than a focusing structure. The above-mentioned variations involving eliminating the frontside exposure, employing multiple frontside exposures and/or multiple backside exposures, and utilizing multiple layers of actinic material are especially applicable to the formation of such other structures. Similarly, additional features can be provided above emitter electrodes 12 or 70 for use in combination with, or substitutes for, control electrodes 28 in blocking part of the backside actinic radiation that passes through emitter openings 18 or 74.

Each opaque emitter electrode 12 or 70 can be part of a composite emitter electrode that includes one or more transparent electrically conductive portions situated above or below electrode 12 or 70. The transparent emitter electrode material extends at least partially across, typically fully across, at least part of, typically all, of emitter openings 18 or 74. The transparent emitter electrode material is largely transmissive of backside actinic radiation 46. Indium-tin oxide is an example of an electrical conductor suitable for the transparent conductive material in such a composite emitter electrode.

Each emitter electrode 12 or 70 can have three or more rails 14, provided that crosspieces 16 are present between at least two of rails 14. When crosspieces 16 are located between each consecutive pair of all of three or more of rails 14, emitter electrodes 12 or 70 essentially become grids. Backside radiation 46 then passes through the grid openings, exemplified by emitter openings 18 in the ladder shape described above for electrodes 12 or 70.

Grid-shaped versions of opaque emitter electrodes 12 or 70 can be combined with electrically conductive transparent material, such as indium-tin oxide, to form composite emitter electrodes. This enables the composite electrodes to have greater electrical conductivity than that typically provided by indium-tin oxide.

One of rails 14 can be deleted from each emitter electrode 12 or 70. Although doing so removes the rail redundancy that facilitates short-circuit repair, the so-modified emitter electrodes can still be employed in the manner described above to form self-aligned structures such as base focusing structure 38.

The actinic radiation can consist of or include light other than UV light. One example is IR light. Similarly, the actinic radiation can consist of or include radiation other than light. Different types of actinic radiation can be employed in different radiation-exposure steps. During the frontside exposure step, the chemical structure of the exposed portions of primary actinic layer 38P can be changed by selectively exposing layer 38P to a directed energy beam, such as a laser, rather than exposing layer 38P through photomask 47.

The actinic material exposed to actinic radiation can change chemical structure by phenomena other than polymerization. This occurs especially when the actinic material is positive tone, the exposed actinic material being removed during the development step. With positive-tone actinic material, the exposed material is typically converted into an acid that can be removed with an aqueous base developer. With positive-tone actinic material, certain lateral edges of the unexposed actinic material remaining after the development step are vertically aligned to parts or all of the longitudinal edges of control electrodes 28 in a manner complementary to that described above.

As an example of variations in the type of actinic radiation and the way of changing chemical structure, primary actinic layer 38P can be thermosetting polymeric material, typically a thermosetting plastic, while backside radiation 46 consists of IR light. Upon being subjected to the IR light, the exposed portions of primary layer 38P harden. Inasmuch as the wavelength of IR light is so long that undesirable light scattering might occur if the frontside exposure were done through a photomask situated a short distance above the top of the field emitter, a laser can be scanned selectively over layer 46P to perform the frontside exposure.

Each of the sets of electron-emissive elements 24 can consist of only one element 24 rather than multiple elements 24. Multiple electron-emissive elements can be situated in one opening through dielectric layer 22. Electron-emissive elements 24 can have shapes other than cones. One example is filaments, while another is randomly shaped particles such as diamond grit.

The principles of the invention can be applied to other types of matrix-addressed flat-panel displays. Candidate flat-panel displays for this purpose include matrix-addressed plasma displays and active-matrix liquid-crystal displays. Various modifications and applications may thus be made by those skilled in the art without departing from the true scope and spirit of the invention as defined in the appended claims.

We claim:

1. A device comprising:

an electrically conductive emitter electrode through which a line of separate emitter openings extend, the emitter electrode being of greater length than width, the line of emitter openings extending along the length of the emitter electrode; and a plurality of laterally separated sets of electron-emissive elements electrically coupled to the emitter electrode, each of the sets of electron-emissive elements overlying a corresponding designated region of the emitter electrode, each designated region located between a different consecutive pair of the emitter openings.

2. A device as in claim 1 wherein the emitter electrode is generally shaped like a bar.

3. A device as in claim 2 wherein the emitter electrode comprises:

a pair of laterally separated generally parallel rails that extend alone the length of the emitter electrode; and a like plurality of laterally separated crosspieces situated between the rails, each crosspiece having a pair of ends that respectively merge into the rails, each crosspiece containing a corresponding one of the designated regions of the emitter electrode.

4. A device as in claim 1 further including electrically resistive material situated between the emitter electrode and each of the sets of electron-emissive elements.

5. A device as in claim 1 further including:

a dielectric layer overlying the emitter electrode and having dielectric openings in which the electron-emissive elements are situated; and a like plurality of control electrodes overlying the dielectric layer and having control openings through which the electron-emissive elements are exposed, each control electrode situated over a different corresponding one of the designated regions of the emitter electrode.

6. A device as in claim 5 further including a focusing system for focusing electrons emitted by the electron-emissive elements, the focusing system overlying the dielectric layer and having lateral edges vertically aligned to parts of longitudinal edges of the control electrodes.

7. A device as in claim 6 wherein:

the emitter electrode is generally shaped like a bar; and the control electrodes are generally parallel and cross over the emitter electrode.

8. A device as in claim 6 wherein the emitter electrode comprises:

a pair of laterally separated generally parallel rails that extend along the length of the emitter electrode; and a like plurality of laterally separated crosspieces situated between the rails, each crosspiece having a pair of ends that respectively merge into the rails, each crosspiece containing a corresponding one of the designated regions of the emitter electrode, the line of emitter openings extending largely in a specified direction, each set of electron-emissive elements occupying an emission region of lesser dimension than the corresponding crosspiece in the specified direction.

9. A device as in claim 8 wherein the control electrodes cross over the emitter electrode, each emission region largely centered on the corresponding control electrode in the specified direction.

10. A device as in claim 9 wherein each control electrode is of greater dimension than the corresponding crosspiece in the specified direction.

11. A device as in claim 6 wherein each control electrode comprises:

a main portion that crosses over the emitter electrode; and a gate portion situated above the corresponding designated region of the emitter electrode, contacting the main portion, and having part of the control openings, each control opening thereby being a gate opening.

12. A device as in claim 11 wherein the main portion of each control electrode is thicker than the gate portion of that control electrode.

13. A device as in claim 6 wherein the focusing system comprises:

an electrically non-conductive base focusing structure situated over the dielectric layer; and an electrically non-insulating focus coating overlying the base structure and spaced apart from the control electrodes.

14. A device as in claim 13 wherein the base focusing structure comprises exposed actinic material.

15. A device as in claim 13 wherein the base focusing structure comprises non-actinic electrically insulating material.

16. A device as in claim 6 wherein the focusing system is spaced apart from the control electrodes.

17. A device as in claim 16 wherein the focusing system consists primarily of electrically non-insulating focus material.

18. A device as in claim 5 further including a focusing system for focusing electrons emitted by the electron-emissive elements, a like plurality of focus openings extending through the focusing system respectively above the sets of electron-emissive elements, the line of emitter openings extending largely in a specified direction, each set of electron-emissive elements occupying an emission region largely centered on the overlying focus opening in the specified direction.

19. A device as in claim 18 wherein each emission region is no more than 50% as long as the overlying focus opening in the specified direction.

20. A device as in claim 19 wherein each control opening is at least 5% as long as the overlying focus opening in the specified direction.

21. A device as in claim 20 wherein each control opening is 15–25% as long as the overlying focus opening in the specified direction.

22. A device as in claim 18 wherein the focusing system is situated largely above the dielectric layer.

23. A device as in claim 5 wherein each control electrode is wider above the corresponding designated region of the emitter electrode than above its longitudinal edges.

24. A device as in claim 5 wherein each control electrode is of greater length than width, the control electrodes extending longitudinally generally perpendicular to the emitter electrode and to the line of emitter openings.

25. A device as in claim 1 wherein:

each of the sets of electron-emissive elements comprises multiple ones of the electron-emissive elements; and the electron-emissive elements in each set are situated at random locations relative to one another.

26. A device comprising:

an electrically conductive emitter electrode through which a line of separate emitter openings extend, the emitter electrode comprising a pair of laterally separated generally parallel rails and a like plurality of laterally separated crosspieces situated between the rails, each crosspiece having a pair of ends that respectively merge into the rails;

a plurality of laterally separated sets of electron-emissive elements electrically coupled to the emitter electrode, each of the sets of electron-emissive elements overlying a corresponding designated region of the emitter electrode, each designated region located between a different consecutive pair of the emitter openings;

a dielectric layer overlying the emitter electrode and having dielectric openings in which the electron-emissive elements are situated; and a like plurality of control electrodes overlying the dielectric layer and having control openings through which the electron-emissive elements are exposed, each control electrode situated over a different corresponding one of the designated regions of the emitter electrode, the control electrodes being generally parallel and crossing over the rails, each control electrode at least partially overlying a corresponding one of the crosspieces, a pair of further openings extending through each control electrode generally above the ends of the corresponding crosspiece.

27. A device as in claim 26 wherein the ends of each crosspiece neck down in width.

28. A device comprising:

an electrically conductive emitter electrode through which a line of separate emitter openings extend;

a plurality of laterally separated sets of electron-emissive elements electrically coupled to the emitter electrode, each of the sets of electron-emissive elements overlying a corresponding designated region of the emitter electrode, each designated region located between a different consecutive pair of the emitter openings;

a dielectric layer overlying the emitter electrode and having dielectric openings in which the electron-emissive elements are situated; and a like plurality of control electrodes overlying the dielectric layer and having control openings through which the electron-emissive elements are exposed, each control electrode situated over a different corresponding one of the designated regions of the emitter electrode, each control electrode comprising (a) a main portion that crosses over the emitter electrode and (b) a gate portion situated above the corresponding designated region, contacting the main portion, being of different thickness than the main portion, and having part of the control openings, each control opening thereby being a gate opening.

29. A device as in claim 28 wherein the main portion is thicker than the gate portion.

30. A device as in claim 28 wherein:

each of the sets of electron-emissive elements comprises multiple ones of the electron-emissive elements; and the electron-emissive elements in each set are situated at random locations relative to one another.

31. A device as in claim 28 wherein the emitter electrode is generally shaped like a bar, the line of emitter openings being situated longitudinally relative to the bar.

32. A device as in claim 31 wherein the emitter electrode comprises:

a pair of laterally separated generally parallel rails; and a like plurality of laterally separated crosspieces situated between the rails, each crosspiece having a pair of ends that respectively merge into the rails, each crosspiece containing a corresponding one of the designated regions of the emitter electrode.

33. A device as in claim 32 wherein the control electrodes are generally parallel and cross over the rails, each control electrode at least partially overlying a corresponding one of the crosspieces, a pair of further openings extending through each control electrode generally above the ends of the corresponding crosspiece.

34. A device as in claim 33 wherein the ends of each crosspiece neck down in width.

35. A device as in claim 28 further including electrically resistive material situated between the emitter electrode and each of the sets of electron-emissive elements.

36. A device as in claim 28 further including a focusing system for focusing electrons emitted by the electron-emissive elements, the focusing system overlying the dielectric layer and having lateral edges vertically aligned to parts of longitudinal edges of the control electrodes.

37. A device as in claim 36 wherein the focusing system comprises:

an electrically non-conductive base focusing structure situated over the dielectric layer; and an electrically non-insulating focus coating overlying the base structure and spaced apart from the control electrodes.

38. A device as in claim 28 wherein each control electrode is wider above the corresponding designated region of the emitter electrode than above its longitudinal edges.

39. A device comprising:

a group of laterally separated electrically conductive emitter electrodes that extend longitudinally generally in a first direction, a line of separate emitter openings penetrating each emitter electrode and extending generally in the first direction;

a group of pluralities of laterally separated sets of electron-emissive elements, each plurality of the sets of electron-emissive elements electrically coupled to a different corresponding one of the emitter electrodes, each of the sets of electron-emissive elements overlying a corresponding designated region of the corresponding emitter electrode, each designated region located between a different consecutive pair of the emitter openings in the corresponding emitter electrode;

a dielectric layer overlying the emitter electrode and having dielectric openings in which the electron-emissive elements are situated; and a like plurality of control electrodes extending over the dielectric layer generally in a second direction different from the first direction and having control openings through which the electron-emissive elements are exposed, each control electrode situated over a different corresponding one of the designated regions of each emitter electrode.

40. A device as in claim 39 wherein the first and second directions are approximately perpendicular to each other.

41. A device as in claim 39 wherein each emitter electrode comprises:

a pair of laterally separated generally parallel rails that extend generally in the first direction; and a like plurality of laterally separated crosspieces situated between the rails, each crosspiece having a pair of ends that respectively merge into the rails, each crosspiece containing a corresponding one of the designated regions of that emitter electrode.

42. A device as in claim 41 wherein the control electrodes cross over the rails, each control electrode at least partially overlying one of the crosspieces of each emitter electrode, a group of pairs of further openings extending through each control electrode, each pair of the further openings located generally above the ends of a corresponding one of the crosspieces.

43. A device as in claim 42 wherein the ends of each crosspiece neck down in width.

44. A device as in claim 39 wherein:

each of the sets of electron-emissive elements comprises multiple ones of the electron-emissive elements; and the electron-emissive elements in each set are situated at random locations relative to one another.

45. A device as in claim 39 further including electrically resistive material situated between (a) the emitter electrodes and (b) the electron-emissive elements.

46. A device as in claim 39 further including a focusing system for focusing electrons emitted by the electron-emissive elements, the focusing system overlying the dielectric layer and having lateral edges vertically aligned to parts of longitudinal edges of the control electrodes.

47. A device as in claim 46 wherein the focusing system comprises:

an electrically non-conductive base focusing structure situated over the dielectric layer; and an electrically non-insulating focus coating overlying the base structure and spaced apart from the control electrodes.

48. A device as in claim 47 wherein the base focusing structure comprises exposed actinic material.

49. A device as in claim 47 wherein the base focusing structure comprises non-actinic electrically insulating material.

50. A device as in claim 39 wherein each control electrode comprises:

a main portion that crosses over the emitter electrodes; and at least one gate portion situated above the corresponding designated region of each emitter electrode, contacting the main portion, and having part of the control openings, each control opening thereby being a gate opening.

51. A device as in claim 50 wherein the main portions are thicker than the gate portions.

52. A device as in claim 39 wherein each control electrode is wider above the corresponding designated region of each emitter electrode than above its longitudinal edges.

* * * * *